US008789284B1

(12) United States Patent
Clardy et al.

(10) Patent No.: US 8,789,284 B1
(45) Date of Patent: Jul. 29, 2014

(54) METHOD TO CONVERT BODY ANTHROPOMETRIC DIMENSIONS INTO MEASUREMENTS SUITABLE FOR MANUFACTURING CUSTOM-FIT CLOTHING BY ADDING MEASUREMENT PROPORTIONAL DESIGN EASE, WEAR EASE, AND FABRIC EASE ADJUSTMENTS

(76) Inventors: Robert Clardy, Renton, WA (US); Kaaren Hoback, Henderson, NV (US)

( * ) Notice: Subject to any disclaimer, the term of this patent is extended or adjusted under 35 U.S.C. 154(b) by 26 days.

(21) Appl. No.: 13/573,204

(22) Filed: Aug. 29, 2012

Related U.S. Application Data

(60) Provisional application No. 61/575,897, filed on Aug. 30, 2011.

(51) Int. Cl.
*A41H 1/00* (2006.01)

(52) U.S. Cl.
CPC ..... *A41H 1/00* (2013.01)
USPC ..... 33/17 R; 33/2 R; 700/132

(58) Field of Classification Search
CPC ..... A41H 1/00
USPC ..... 33/2 R, 4, 11, 17 A, 17 R, 512, 679.1
See application file for complete search history.

(56) References Cited

U.S. PATENT DOCUMENTS 5,163,006 A 11/1992 Deziel
5,163,007 A 11/1992 Slilaty
5,559,709 A 9/1996 Ohno
5,680,314 A 10/1997 Patterson
5,768,135 A 6/1998 Park
5,930,769 A 7/1999 Rose
5,956,525 A 9/1999 Minsky
6,473,671 B1 10/2002 Yan
6,665,577 B2 12/2003 Onyshkevych et al.
6,701,207 B1 3/2004 Gazzuolo
7,020,538 B2 3/2006 Luhnow
7,242,999 B2 7/2007 Wang
7,617,016 B2 11/2009 Wannier et al.
8,073,560 B1 * 12/2011 Clardy et al. ..... 700/132
2002/0103566 A1 8/2002 Gadson
2002/0138170 A1 9/2002 Onyshkevych et al.
2004/0186611 A1 9/2004 Wang
2004/0236456 A1 * 11/2004 Pieper et al. ..... 700/132
2005/0080505 A1 4/2005 Luhnow
2006/0195219 A1 8/2006 Luhnow et al.
2006/0287877 A1 12/2006 Wannier et al.
2007/0005174 A1 * 1/2007 Thomas ..... 700/132
2007/0032898 A1 2/2007 Wang
2008/0126190 A1 * 5/2008 Gosnell ..... 705/14

(Continued)

OTHER PUBLICATIONS

"Do You Really Know Your Pattern Size? from Simplicity, McCalls, Vogue / Butterick"; http://www.simplicity.com/section/fittips/fitbrochure/fitbroch.pdf, 1988.

(Continued)

*Primary Examiner* — G. Bradley Bennett
(74) *Attorney, Agent, or Firm* — Lowe Graham Jones PLLC

(57) ABSTRACT

A method for automatically generating custom garment specific measurement charts is disclosed. The method derives charts from an individual's anthropomorphic body measurements plus ease amounts that are proportional to those measurements and which vary based on the type of garment to be made, the intended fit preference, and the stretch amount of fabric to be used.

20 Claims, 6 Drawing Sheets

Example Design and Wear Ease For Different Garment Types

Each Amount Is Added To The Respective Body Measurement To Obtain The Comparable Garment Measurement

| | | Front Bust or Chest | Back Bust or Chest | Front Waist | Back Waist | Ab | Hip | Women's Shoulder Length | Men's Shoulder Length | Armscye | Upper Arm | Wrist |
|---|---|---|---|---|---|---|---|---|---|---|---|---|
| **All Garments Start With:** | Standard Fit | 2.5% | 7.5% | 5.0% | 5.0% | 3.5% | 5.0% | 10.0% | 10.0% | 20.0% | 25.0% | 20.0% |
| **Exceptions are:** | | | | | | | | | | | | |
| **Tops / Blouses / Dresses** | Form Fit | 2.5% | 2.5% | 5.0% | 5.0% | 3.5% | 5.0% | 10.0% | 10.0% | 15.0% | 20.0% | 10.0% |
| | Close Fit* | 2.5% | 7.5% | 2.5% | 7.5% | 3.5% | 5.0% | 5.0% | 5.0% | 20.0% | 25.0% | 10.0% |
| | Sleeveless Fit | 1.25% | 8.75% | 5.0% | 5.0% | 3.5% | 5.0% | 10.0% | 10.0% | 20.0% | N/A | N/A |
| | Shoulderless Fit | 0.0% | 0.0% | 5.0% | 5.0% | 3.5% | 5.0% | 10.0% | 10.0% | 20.0% | N/A | N/A |
| | Jumpers | 2.5% | 7.5% | 5.0% | 5.0% | 3.5% | 5.0% | 10.0% | 10.0% | 35.0% | N/A | N/A |
| | Casual Fit | 5.0% | 10.0% | 10.0% | 10.0% | 6.0% | 7.5% | 10.0% | 10.0% | 20.0% | 25.0% | 25.0% |
| | Comfort Fit | 7.5% | 12.5% | 12.5% | 12.5% | 8.5% | 10.0% | 10.0% | 10.0% | 20.0% | 25.0% | 25.0% |
| | Loose Fit | 10.0% | 15.0% | 15.0% | 15.0% | 10.0% | 12.0% | 10.0% | 10.0% | 20.0% | 25.0% | 25.0% |
| | Unfitted | 2.5% | 7.5% | 5.0% | 5.0% | 3.5% | 5.0% | 10.0% | 10.0% | 20.0% | 25.0% | 25.0% |
| **Vests** | Standard Fit | 2.5% | 15.0% | 10.0% | 15.0% | 10.0% | 10.0% | -8.0% | -8.0% | 30.0% | N/A | N/A |
| | Casual Fit | 5.0% | 17.5% | 12.5% | 17.5% | 12.5% | 12.5% | -8.0% | -8.0% | 30.0% | N/A | N/A |
| | Comfort Fit | 7.5% | 20.0% | 15.0% | 20.0% | 15.0% | 15.0% | -8.0% | -8.0% | 30.0% | N/A | N/A |
| **Tunics** | Standard Fit | 2.5% | 7.5% | 5.0% | 10.0% | 5.0% | 5.0% | 10.0% | 10.0% | 20.0% | 25.0% | 25.0% |
| | Casual Fit | 5.0% | 10.0% | 7.5% | 12.5% | 7.5% | 7.5% | 10.0% | 10.0% | 22.5% | 27.0% | 27.0% |
| | Comfort Fit | 7.5% | 12.5% | 10.0% | 15.0% | 10.0% | 10.0% | 10.0% | 10.0% | 25.0% | 29.0% | 29.0% |
| **Indoor Jackets** | Close Fit** | 5.0% | 15.0% | 10.0% | 15.0% | 5.0% | 10.0% | 18.0% | N/A | 45.0% | 25.0% | 20.0% |
| | Standard Fit*** | 5.0% | 15.0% | 10.0% | 15.0% | 5.0% | 10.0% | 20.0% | 30.0% | 45.0% | 25.0% | 20.0% |
| | Casual Fit | 5.0% | 15.0% | 10.0% | 15.0% | 5.0% | 10.0% | 20.0% | 30.0% | 48.0% | 28.0% | 20.0% |
| | Relaxed Fit | 5.0% | 15.0% | 10.0% | 15.0% | 5.0% | 10.0% | 30.0% | 35.0% | 48.0% | 28.0% | 20.0% |
| **Outdoor Jackets** | Standard Fit | 5.0% | 15.0% | 15.0% | 20.0% | 10.0% | 17.0% | 20.0% | 40.0% | 60.0% | 42.0% | 22.0% |
| | Casual Fit | 5.0% | 15.0% | 15.0% | 20.0% | 10.0% | 17.0% | 20.0% | 40.0% | 60.0% | 48.0% | 22.0% |
| **Outdoor Coats** | Standard Fit | 5.0% | 15.0% | 15.0% | 20.0% | 10.0% | 17.0% | 25.0% | 60.0% | 68.0% | 42.0% | 22.0% |
| | Casual Fit | 5.0% | 15.0% | 15.0% | 20.0% | 10.0% | 17.0% | 33.0% | 60.0% | 70.0% | 48.0% | 22.0% |
| **Loungewear** | Standard / Loose Fit | 20.0% | 20.0% | 20.0% | 20.0% | 20.0% | 20.0% | 20.0% | 20.0% | 45.0% | 25.0% | 25.0% |

* Bodice or Sheath
** Over silk or nothing
*** Over long sleeved shirt

(56) References Cited

U.S. PATENT DOCUMENTS

| | | | | |
|---|---|---|---|---|
| 2008/0312765 | A1* | 12/2008 | Gardiner et al. | 700/132 |
| 2009/0222127 | A1* | 9/2009 | Lind | 700/132 |
| 2009/0319076 | A1* | 12/2009 | Fernandez | 700/132 |
| 2012/0185074 | A1* | 7/2012 | Bittner et al. | 700/131 |
| 2013/0227847 | A1* | 9/2013 | Peake | 33/17 R |
| 2013/0312273 | A1* | 11/2013 | Tulin | 33/2 R |

OTHER PUBLICATIONS

Size Designation of Clothes—Women's and girls' outerwear garments; International Organization for Standardization ISO 3637 : 1977; Published Oct. 15, 1990.

Standard Tables of Body Measurements for Women Aged 55 and Older (All Figure Types); ASTM International; Designation: D 5586-01.

Standard Tables of Body Measurements for Boys, Sizes 8 to 14 Slim and 8 to 20 Regular; ASTM International; Designation: D 6458-99.

Standard Tables of Body Measurements for Men Sizes Thirty-Four to Sixty (34 to 60) Regular; ASTM International; Designation: D 6240-98.

Standard Tables of Body Measurements for Girls, Sizes 7 to 16; ASTM International; Designation: D 6192-98.

Standard Tables of Body Measurements for Children, Sizes 2 to 6×/7; ASTM International; Designation: D 5826-00.

Standard Tables of Body Measurements for for Adult Female Misses Figure Type, Sizes 2-20; ASTM International; Designation: D 5585-95 (Reapproved 2001).

A Survey of Standards for the US Fiber/Textile/Apparel Industry, Craig G. Pawlak, U.S. Department of Commerce, Technology Admin., National Institutes of Standards; Apr. 1996.

* cited by examiner

Figure 1: Process Overview: Making Custom Apparel
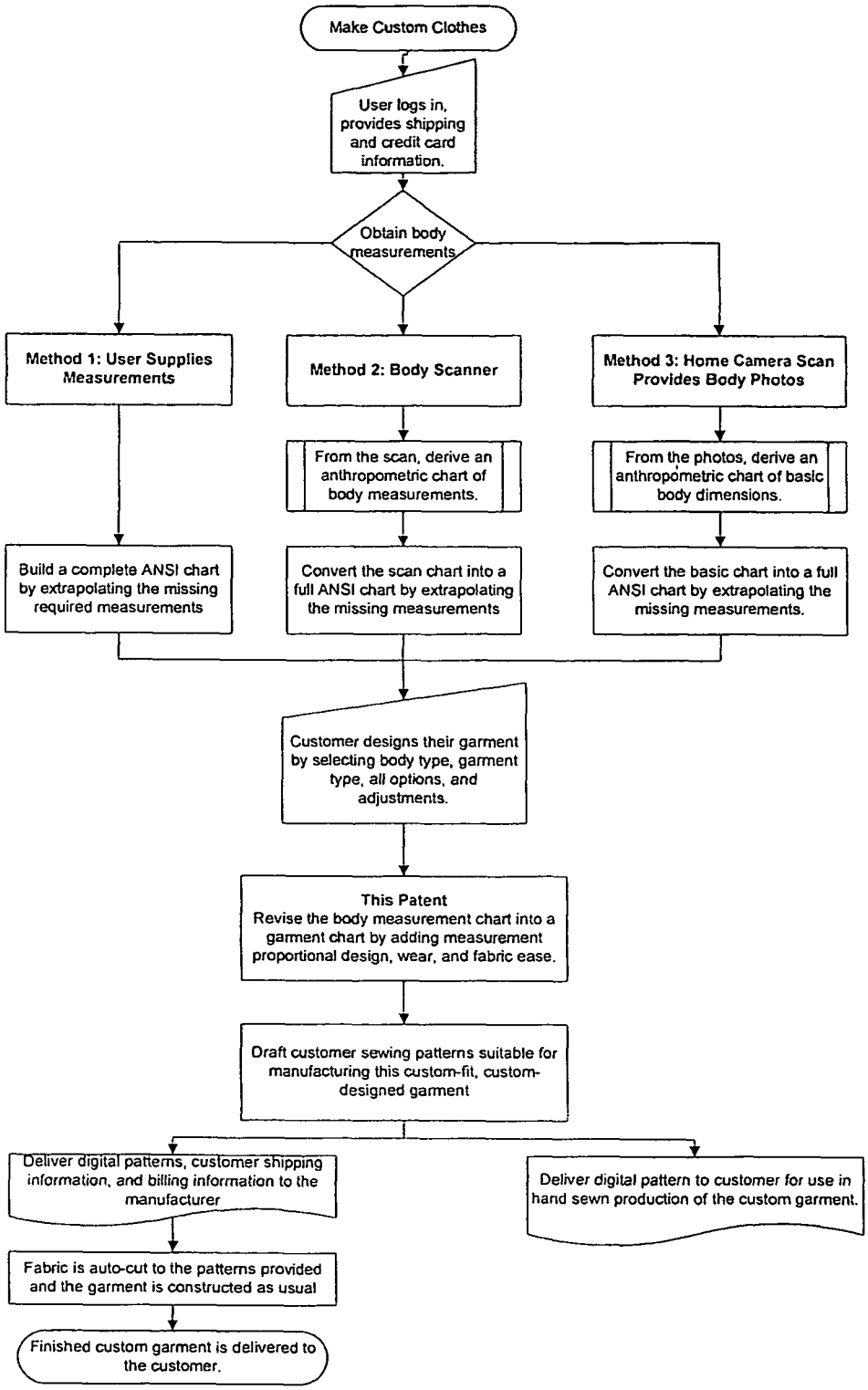

Figure 2: Invention Process
Convert Body Measurements to Garment Measurements by Adding Appropriate Ease
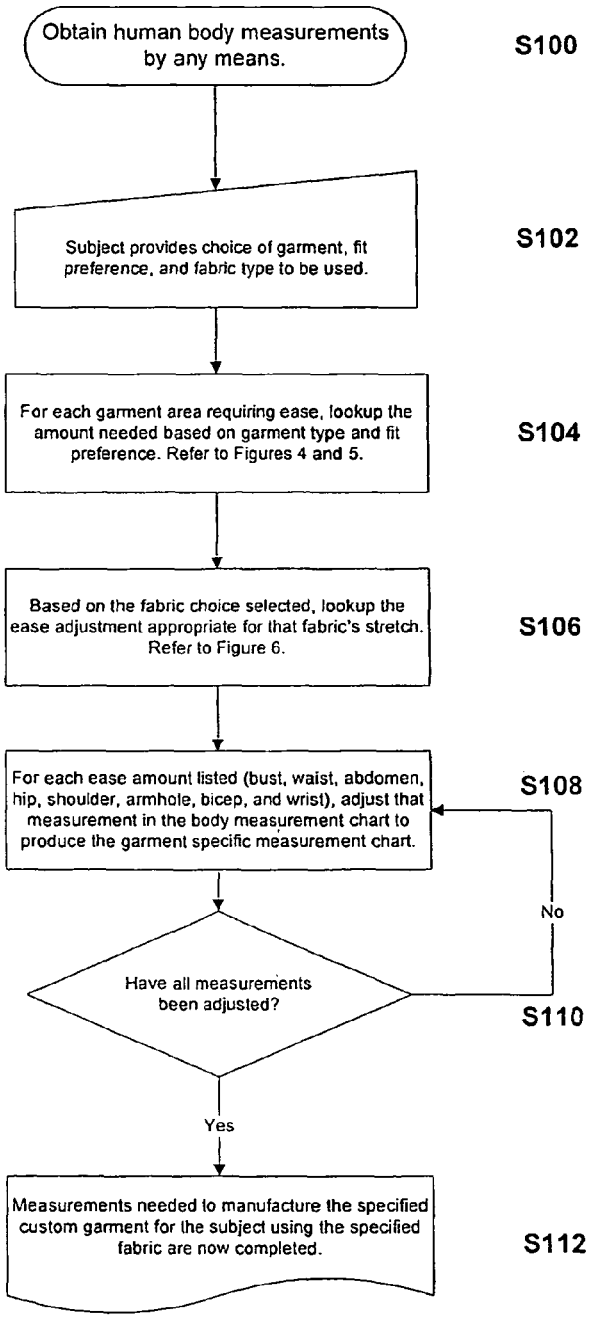

Figure 3: ASTM / ANSI Measurements Description

| Index | Measurement | Group | Description of Each Measurement and How To Take It |
|---|---|---|---|
| 0 | Bust | Upper Torso Girth | Measure the bust circumference horizontally around the body under the arms, across the nipples, and parallel to the floor. |
| 1 | Waist | Lower Torso Girth | Measure the waist circumference horizontally around the body at the waist level. |
| 2 | High-Hip | Lower Torso Girth | Measure the high hip circumference of the body at high-hip level, approximately 7.5 cm (3 in.) below the waist level and parallel to the floor. |
| 3 | Hip | Lower Torso Girth | Measure the maximum hip circumference of the body at the hip level and parallel to the floor. |
| 4 | Mid-Neck | Upper Torso Girth | Measure the mid neck circumference of the neck approximately 25 cm (1 in.) above the neck base. |
| 5 | Neck Base | Upper Torso Girth | With tape measure standing on edge, measure the circumference of the neck base crossing the cervicale at the back, shoulder line/neck base at side, and hollow at center front. |
| 6 | Armscye | Upper Torso Vert. | With the arm hanging down, measure from the shoulder joint down through the front-break point, the armpit, up to the back-break point, and up to the starting point. |
| 7 | Upper Arm | Arm Girth | With the arm down, measure the maximum upper arm circumference parallel to the floor between the shoulder joint and the elbow. |
| 8 | Elbow | Arm Girth | With the arm bent, measure the elbow circumference. |
| 9 | Wrist | Arm Girth | Measure the wrist circumference over the inner and outer prominence at the lower end of the forearm. |
| 10 | Thigh, Max | Leg Girth | Measure the circumference of the upper leg close to the crotch. |
| 11 | Thigh, Mid | Leg Girth | Measure the circumference of the upper leg midway between the hip and the knee. |
| 12 | Knee | Leg Girth | With the leg straight, measure the knee circumference over the knee cap and parallel to the floor. |
| 13 | Calf | Leg Girth | Measure the maximum circumference of the lower leg between the knee and the ankle and parallel to the floor. |
| 14 | Ankle | Leg Girth | Measure the ankle circumference over the inner and outer bony prominence at the lower end of the lower leg. |
| 15 | Vertical Trunk | Upper Torso Vert. | Measure from a point on the right shoulder midway between the neck base and shoulder joint, down the back, through the crotch, and up over the prominence of the right breast to the starting point, taking care to avoid constriction at the crotch. |
| 16 | Total Crotch length | Lower Torso Girth | Measure from the center front waist level through the crotch to the center back waist level. |
| 17 | Height | Upper Torso Vert. | In a standing position, measure from the top of the head to the soles of the feet. |
| 18 | Height Cervicale | Upper Torso Vert. | Measure from the cervicale following the contour of the spinal column to the level of the hips, then vertically to the soles of the feet. |
| 19 | Height Waist | Leg Length | Measure from the waist level at the side of the body following the contour of the body to hip level, then vertically to the soles of the feet. |
| 20 | Height High-Hip | Leg length | At the side of the body, measure from the level of the prominent high-hip (abdominal extension) following the contour of the body to the soles of the feet. |
| 21 | Hip Height | Leg Length | At the side of the body, measure from the full hip level to the soles of the feet. |
| 22 | Crotch Height | Leg Length | While standing erect without shoes and with feet slightly apart, measure from the crotch straight down to the soles of the feet. |
| 23 | Knee Height | Leg Length | Measure from the crease in the back of the knee to the soles of the feet. |
| 24 | Ankle Height | Leg Length | Measure from the middle of the outer ankle bone to the soles of the feet. |
| 25 | Waist Length (front) | Upper Torso Vert. | Measure from the center front neck base line to the center front waist level. |
| 26 | Waist Length (back) | Upper Torso Vert. | Measure from the cervicale following the contour of the spinal column to the center back waist level. |
| 27 | True Rise | Leg Length Upper | While sitting on a hard, flat surface, measure straight down from the waist level at the side of the body to the flat surface. |
| 28 | Across Shoulder | Torso Girth Upper | While standing erect with the arms hanging down, measure across the back from one shoulder joint to the other. |
| 29 | Cross-Back Width | Torso Girth Upper | Measure across the back from armscye to armscye at the back-break point level. |
| 30 | Cross-Chest Width | Torso Girth Upper | Measure across the chest from armscye to armscye at the front-break point level. |
| 31 | Shoulder Length | Torso Girth Upper | With the arm hanging down, measure from the side of the neck base to the armscye line at the shoulder joint. |
| 32 | Shoulder Slope | Torso Girth | Using a goniometer, position the measure on the shoulder and move the baseline until it is parallel to the floor; identify on the dial the degrees of difference between the shoulder slant and the horizontal measure of the goniometer. |
| 33 | Arm Length (shoulder to wrist) | Arm Length | With the arm bent at 90 degrees and the hand placed on the hip, measure from the shoulder joint down along the outside of the arm over the elbow to the prominent wrist bone. |
| 34 | Arm Length (shoulder to elbow) | Arm Length | With the arm bent at 90 degrees and the hand placed on the hip, measure from the shoulder joint along the outside of the arm to the center elbow bone. |
| 35 | Arm Length (back neck to wrist) | Arm Length | With the arm bent at 90 degrees, measure from the cervicale over the top of the shoulder to the shoulder joint, then along the outside of the arm over the elbow to the prominent wrist bone. |
| 36 | Bust Point to Bust | Upper Torso Girth | Measure horizontally from one bust apex to the other. |
| 37 | Neck to Bust Point | Upper Torso Vert. | Measure from the intersection of shoulder and front neck base to the bust apex. |
| 38 | Scye Depth | Upper Torso Vert. | Measure vertically on the body from the cervicale to the upper edge of a tape passed horizontally under the armpits. |
| 39 | Weight | n/a | Weight |

Figure 4: Example Design and Wear Ease For Different Garment Types

Each Amount Is Added To The Respective Body Measurement To Obtain The Comparable Garment Measurement

| | | Front Bust or Chest | Back Bust or Chest | Front Waist | Back Waist | Ab | Hip | Women's Shoulder Length | Men's Shoulder Length | Armscye | Upper Arm | Wrist |
|---|---|---|---|---|---|---|---|---|---|---|---|---|
| **All Garments Start With:** | Standard Fit | 2.5% | 7.5% | 5.0% | 5.0% | 3.5% | 5.0% | 10.0% | 10.0% | 20.0% | 25.0% | 20.0% |
| **Exceptions are:** | | | | | | | | | | | | |
| **Tops / Blouses / Dresses** | Form Fit | 2.5% | 2.5% | 5.0% | 5.0% | 3.5% | 5.0% | 10.0% | 10.0% | 15.0% | 20.0% | 10.0% |
| | Close Fit* | 2.5% | 7.5% | 2.5% | 7.5% | 3.5% | 5.0% | 5.0% | 5.0% | 20.0% | 25.0% | 10.0% |
| | Sleeveless Fit | 1.25% | 8.75% | 5.0% | 5.0% | 3.5% | 5.0% | 10.0% | 10.0% | 20.0% | N/A | N/A |
| | Shoulderless Fit | 0.0% | 0.0% | 5.0% | 5.0% | 3.5% | 5.0% | 10.0% | 10.0% | 20.0% | N/A | N/A |
| | Jumpers | 2.5% | 7.5% | 5.0% | 5.0% | 3.5% | 5.0% | 10.0% | 10.0% | 35.0% | N/A | N/A |
| | Casual Fit | 5.0% | 10.0% | 10.0% | 10.0% | 6.0% | 7.5% | 10.0% | 10.0% | 20.0% | 25.0% | 25.0% |
| | Comfort Fit | 7.5% | 12.5% | 12.5% | 12.5% | 8.5% | 10.0% | 10.0% | 10.0% | 20.0% | 25.0% | 25.0% |
| | Loose Fit | 10.0% | 15.0% | 15.0% | 15.0% | 10.0% | 12.0% | 10.0% | 10.0% | 20.0% | 25.0% | 25.0% |
| | Unfitted | 2.5% | 7.5% | 5.0% | 5.0% | 3.5% | 5.0% | 10.0% | 10.0% | 20.0% | 25.0% | 25.0% |
| **Vests** | Standard Fit | 2.5% | 15.0% | 10.0% | 15.0% | 10.0% | 10.0% | -8.0% | -8.0% | 30.0% | N/A | N/A |
| | Casual Fit | 5.0% | 17.5% | 12.5% | 17.5% | 12.5% | 12.5% | -8.0% | -8.0% | 30.0% | N/A | N/A |
| | Comfort Fit | 7.5% | 20.0% | 15.0% | 20.0% | 15.0% | 15.0% | -8.0% | -8.0% | 30.0% | N/A | N/A |
| **Tunics** | Standard Fit | 2.5% | 7.5% | 5.0% | 10.0% | 5.0% | 5.0% | 10.0% | 10.0% | 20.0% | 25.0% | 25.0% |
| | Casual Fit | 5.0% | 10.0% | 7.5% | 12.5% | 7.5% | 7.5% | 10.0% | 10.0% | 22.5% | 27.0% | 27.0% |
| | Comfort Fit | 7.5% | 12.5% | 10.0% | 15.0% | 10.0% | 10.0% | 10.0% | 10.0% | 25.0% | 29.0% | 29.0% |
| **Indoor Jackets** | Close Fit** | 5.0% | 15.0% | 10.0% | 15.0% | 5.0% | 10.0% | 18.0% | N/A | 45.0% | 25.0% | 20.0% |
| | Standard Fit*** | 5.0% | 15.0% | 10.0% | 15.0% | 5.0% | 10.0% | 20.0% | 30.0% | 45.0% | 25.0% | 20.0% |
| | Casual Fit | 5.0% | 15.0% | 10.0% | 15.0% | 5.0% | 10.0% | 20.0% | 30.0% | 48.0% | 28.0% | 20.0% |
| | Relaxed Fit | 5.0% | 15.0% | 10.0% | 15.0% | 5.0% | 10.0% | 30.0% | 35.0% | 48.0% | 28.0% | 20.0% |
| **Outdoor Jackets** | Standard Fit | 5.0% | 15.0% | 15.0% | 20.0% | 10.0% | 17.0% | 20.0% | 40.0% | 60.0% | 42.0% | 22.0% |
| | Casual Fit | 5.0% | 15.0% | 15.0% | 20.0% | 10.0% | 17.0% | 20.0% | 40.0% | 60.0% | 48.0% | 22.0% |
| **Outdoor Coats** | Standard Fit | 5.0% | 15.0% | 15.0% | 20.0% | 10.0% | 17.0% | 25.0% | 60.0% | 68.0% | 42.0% | 22.0% |
| | Casual Fit | 5.0% | 15.0% | 15.0% | 20.0% | 10.0% | 17.0% | 33.0% | 60.0% | 70.0% | 48.0% | 22.0% |
| **Loungewear** | Standard / Loose Fit | 20.0% | 20.0% | 20.0% | 20.0% | 20.0% | 20.0% | 20.0% | 20.0% | 45.0% | 25.0% | 25.0% |

* Bodice or Sheath

** Over silk or nothing

*** Over long sleeved shirt

Figure 5: Example Design and Wear Ease For Pants and Skirts

| | | Front Waist | Back Waist | Ab | Hip |
|---|---|---|---|---|---|
| All Garments Start With: | Standard Fit | 0.00% | 0.00% | 0.00% | 0.00% |
| | | | | | |
| Exceptions are: | Casual Fit | 0.00% | 0.00% | 2.50% | 2.50% |
| | Relaxed Fit | 0.00% | 0.00% | 5.00% | 5.00% |

Figure 6: Example Garment Ease Adjustments For Stretch Fabrics Based on Fabric and Garment Type

| Stretch Fabric | Blouses | | Dresses | | Pants | | Casual Tops and Tees | | Swimsuits | | Board sports | | Intimates, Lingerie, Sleep | |
|---|---|---|---|---|---|---|---|---|---|---|---|---|---|---|
| Organics: | Fabric stretch % | Ease Adjust | Fabric Stretch% | Ease Adjust | Fabric Stretch% | Ease Adjust | Fabric Stretch % | Ease Adjust | Fabric Stretch% | Ease Adjust | Fabric Stretch % | Ease Adjust | Fabric Stretch % | Ease Adjust |
| Cotton / cotton blends-Interlocks | 45-75% | -1.8% | 45-75% | -1.8% | 45-75% | -1.0% | 45-75% | -1.8% | n/a | n/a | | n/a | 45-75% | -1.5% |
| Wool and wool blends jerseys | 50-100% | -2.4% | 50-100% | -2.4% | 45-75% | -1.5% | 45-75% | -2.4% | n/a | n/a | | n/a | 45-75% | -2.4% |
| Linen and Linen Blends | 15-40% | -0.8% | 15-40% | -0.8% | 15-40% | -0.1% | 15-40% | -0.8% | n/a | n/a | | n/a | 15-40 | -0.3% |
| Silk and silk blends | 50-80% | -0.3% | 50-80% | -0.3% | 50-80 | -0.1% | 50-80% | -0.3% | n/a | n/a | | n/a | 50-80 | -0.3% |
| Hemp and blends | 10-25% | -0.1% | 10-25% | -0.1% | 10-25% | -0.1% | 10-25% | -0.1% | n/a | n/a | | n/a | n/a | n/a |
| Eco fabrics | | | | | | | | | | | | | | |
| Bamboo jersey | 75-100% | -2.4% | 75-100% | -2.4% | 75-100% | -1.5% | 75-100% | -2.4% | n/a | n/a | | n/a | 75-100% | -2.4% |
| Corn/Soy jersey | 50-100% | -2.4% | 50-100% | -2.4% | 50-100% | -1.5% | 50-100% | -2.4% | n/a | n/a | | n/a | | 0.0% |
| Synthetics | | | | | | | | | | | | | | |
| Lycra | 75-100% | -2.4% | 75-100% | -2.4% | 75-100% | -1.5% | 75-100% | -2.4% | 85-100% | -8%H -6%V | 60H 30V% | -6%H -3%V | 85-100 | -2.4% |
| Polyester - single or double knit | 15-35% | -0.8% | 15-35% | -0.8% | 15-35% | -0.3% | 15-35% | -0.8% | n/a | n/a | | n/a | 15-35 | -0.5% |
| Nylon and tricot | 65-100% | -2.4% | 65-100% | -2.4% | 65-100% | -1.5% | 65-100% | -1.5% | n/a | n/a | | n/a | 65-100 | -2.4% |
| Neoprene - normal stretch | n/a | n/a | n/a | n/a | n/a | n/a | n/a | n/a | n/a | n/a | 100% | -2.50% | n/a | n/a |
| Actetates and Linings | 50-100% | -1.8% | 50-100% | -2.4% | 50-100% | -1.5% | 50-100% | -1.8% | n/a | n/a | | n/a | 50-100 | -1.8% |
| Mesh- athletic | 80-100% | -4.0% | 80-100% | -4.0% | 80-100% | n/a | 80-100% | -4.0% | 80-100% | -4.0% | | n/a | | n/a |
| Rayon | 65-100% | -2.4% | 60-100% | -2.4% | 65-100% | -1.5% | 65-100% | -1.8% | n/a | n/a | | n/a | | n/a |
| Raschel | 85-100% | -4.0% | 85-100 | -4.0% | 85-100% | -3.0% | 85-100% | -4.0% | 100% | -8%H -6%V | 60%H 30%V | -6%H -3%V | 80-100% | -4.0% |
| Slinky | 60-100% | -3.5% | 60-100% | -3.5% | 60-100 | -1.5% | 60-100% | -3.5% | n/a | n/a | | n/a | 60-100% | -3.5% |
| Spandex | 100% | -3.5% | 100% | -3.5% | 100% | -1.5% | 100% | -3.5% | 100% | -8%H -6%V | 60H%H 30%V | -6%H -3%V | 100% | -3.5% |
| Stretch Denim | 10-40% | -0.3% | 10-40% | -0.3% | 10-40% | -0.1% | 10-40% | -0.3% | n/a | n/a | | n/a | 10-40% | -0.3% |
| Supplex | 75-100% | -2.4% | 75-100% | -2.4% | 75-100% | -1.5% | 75-100% | -2.4% | n/a | n/a | | n/a | 75-100 | -2.4% |
| French Terry | 75-100% | -2.4% | 75-100% | -2.4% | 75-100% | -1.5% | 75-100 | -2.4% | 75-100% | -6%H -3%V | | n/a | 75-100% | -1.8% |
| Velour | 75-100% | -1.8% | 75-100% | -1.8% | 75-100% | -1.5% | 75-100% | -1.8% | 75-100% | -6%H -3%V | | n/a | 75-100% | -2.4% |
| Velvets | 30-50% | -0.6% | 30-50% | -0.6% | 30-50% | -0.3% | 30-50% | -0.6% | n/a | n/a | | n/a | 30-50% | -0.3% |

METHOD TO CONVERT BODY ANTHROPOMETRIC DIMENSIONS INTO MEASUREMENTS SUITABLE FOR MANUFACTURING CUSTOM-FIT CLOTHING BY ADDING MEASUREMENT PROPORTIONAL DESIGN EASE, WEAR EASE, AND FABRIC EASE ADJUSTMENTS

CROSS REFERENCE TO RELATED APPLICATIONS

This non-provisional utility patent application claims the benefit of the filing date of copending U.S. provisional patent application Ser. No. 61/575,897 filed Aug. 30, 2011 under 35 U.S.C. §119(e) and priority under 35 U.S.C. §120.

TECHNICAL FIELD

The present invention relates generally to the computer-aided design of custom fit sewing patterns and the manufacturing of custom apparel. More particularly, this invention provides an apparatus for the automated generation of the garment and fabric specific measurements needed to manufacture custom apparel. These garment specific measurements are developed from the subject's specific actual body measurements to which ease (additional fabric in a garment to provide for comfortable body movement) is added, proportional to those measurements and varying based on the garment type, fit type preferred, and stretch of the fabric to be used.

BACKGROUND OF THE INVENTION

The garment making industry has historically used a number of standard body measurement charts to produce garments. Various industry and governmental institutions such as the American National Standards Institute or ANSI have developed these standardized body measurement charts over time. At this time, there are several hundred such standard charts available for different body types (e.g. child, girl, misses, woman, and woman over 55). But, these charts have never fully represented the broad diversity of actual body types. They all assume an average height between 5'5"-5"6" for all women in the world, for instance. Nor do these standard charts keep up with the changing shape of the average body as it varies with the evolving health, diet, and exercise habits of our populace. The challenge for the "average" clothing buyer to find clothes that actually fit well has become more and more difficult, resulting in trends towards poorer fit with fewer options available for the short, the tall, the skinny, and the wider clothing buyers.

With the advent of three-dimensional body scanners (commercial as well as home based), it has become possible to generate accurate anthropometric representation of the scanned human body. Those measurements provide an accurate representation of the surface of the human body, but do not include the requisite ease required for different garment types and uses. An overcoat needs to be looser than a leotard, for instance. In the past, ease has generally been provided in fixed amounts for each garment type, sometimes varied based on body somototypes (general body shapes). These fixed amounts of ease were appropriate for mass-produced clothing, based on standard sizes. But, with the availability of measurements that more accurately reflect the specific human body the garment is being manufactured for, ease that is proportional to that individual's actual body measurements will produce better fitting garments.

BRIEF SUMMARY OF THE INVENTION

Described below is a process to automatically generate "custom" garment specific measurement charts derived from an individual's actual anthropometric body measurements plus ease amounts that are proportional to those measurements and which vary based on the intended type of garment to be made, the desired fit of that garment, and the stretchiness of the fabric to be used to manufacture the garment. The amount of ease needed at front and back bust, front and back waist, abdomen, hip, shoulder extension, bicep, wrist, and armhole depth can all be determined from the subject's actual body dimensions, but the ease amounts used must vary based on the type of garment being manufactured (from underwear to outerwear). The percentage ease amounts also must vary based on the desired type of fit—form fit, close fit, standard fit, casual fit, comfort fit, loose fit, or unfitted, for instance.

The ease percentages also need to vary to account for the specific fabric properties for woven and/or stretch fabric to be used to make the custom-fit garment. Non-stretch fabrics need no ease adjustment to accommodate fabric stretch. But, any stretchable fabric should have the ease amounts reduced slightly to allow the fabric to provide some of the movement ease required. The amount of the adjustment varies based on the type of fabric, amount of stretch, hand, recovery, memory, weight, and general style intent of the fabric being used.

Once final ease percentages have been determined for those parts of the garment that require it, a garment specific measurement chart can be created from the subject's body measurement chart, with each amount to be increased or decreased by the appropriate ease percentage. That final chart can then be used to produce computer generated, digital sewing patterns from commercially available automated sewing pattern software. Those digital patterns would then be used for either hand sewn or automated manufacture of the desired custom-fit, custom-designed garment.

BRIEF DESCRIPTION OF THE FIGURES

FIG. 1 is a process chart showing the complete process of obtaining accurate bodily measurements of an individual by any of several different methods, adding garment ease to these measurements, then using the resulting garment dimensions to manufacture custom fit apparel.

FIG. 2 is a process chart for this invention, showing the specific steps to convert bodily dimensions into garment measurements.

FIG. 3 is a sample measurement chart for manufacturing garments. It is produced by the American Society for Testing and Materials (ASTM) and distributed by the American National Standards Institute (ANSI). The chart includes a description of how each measurement is normally obtained. A custom chart including each of these measurements specific to the individual customer must be either obtained by hand measuring, body scanning, photo analysis, or any other method.

FIG. 4 shows example proportional ease percentages that can be used for different upper body garment types with different fit preferences.

FIG. 5 shows example proportional ease percentages that can be used for pants and skirts with different fit preferences.

FIG. 6 shows example adjustment to the ease required by several sample fabrics to be used to manufacture the custom garment. The amount of ease required for different fabrics varies based on that fabric's stretch, hand, recovery, memory, weight, and general style intent. There are many other fabrics, of course, which would have similar ease adjustment amounts.

DETAILED DESCRIPTION OF THE PREFERRED EMBODIMENTS

1. An accurate representation of the subject's actual body measurements is obtained and referred to herein as the "Custom Measurement Chart". The ASTM charts provide one example of the list of body measurements required to manufacture custom apparel (refer to FIG. 3). This chart represents the actual body dimensions. Garments manufactured to these measures will be form-fitted or skin-tight. As shown in Step S100 in FIG. 2, this chart can be obtained by a variety of methods, including but not limited to:

a. Subject takes their own measurements with help from a family member, friend, tailor, seamstress, or body measuring professional or service.
b. Measurements are obtained from any of the commercial body scanners.
c. Measurements are obtained from a home-based body scanning device.

2. With some body types, a better fit can be obtained by separately measuring front and back waist, front and back bust, and by also separately measuring the abdomen or ab measurement at the point of largest girth below the waist, but above the hips. Ease amounts used for these more refined measurements are provided. For total girth waist or bust measurements, the average of front and back ease amounts should be used.

3. The "Custom Measurement Chart" will be converted to garment specific measurements by adding ease. The ease amounts required include:

a. Design ease—added room required based on the nature of the garment type (underwear to outerwear).
b. Wear ease—the room to move based on the preference of the customer. Wear ease includes the difference between the range from stretch-to-fit (gym wear), form-fit (no wear ease), standard fit (some wear ease), casual fit (more room for non-dressy situations), comfort fit (loose fit for lounging at home) and unfitted (hide the form, overalls, baggy over-clothing, etc.).
c. Fabric ease. For those fabrics that have some stretch to them, the ease used for the garment's manufacture should be reduced somewhat as the fabric itself can provide some of the ease required as it stretches to accommodate movement.

4. As shown in Step S102 in FIG. 2, the customer must provide information about the garment to be made. To determine what ease percentages are required, you must know the type of garment desired (pants, skirt, dress, blouse, shirt, jacket, etc.), the type of fit preferred (form-fit, standard, casual, comfort, unfitted, etc.) and the type of fabric to be used to manufacture it.

5. As shown in Step S104 in FIG. 2, use the table in FIG. 4 (for pants and skirts only, use Table 5) to look up the ease percentage amounts to be used for the selected garment and preferred fit type. Note that there are different horizontal and vertical ease amounts for some garment types like swimsuits.

6. As shown in Step S106 in FIG. 2, use the table in FIG. 6 to adjust each ease amount obtained in step 4 above, by multiplying it by the appropriate fabric stretch adjustment.

7. As shown in Step S108 in FIG. 2, the values in the "Custom Measurement Chart" that are associated with the ease amounts from step 6 (the name of the ease amount determines which body measurement it applies to) will be multiplied by those amounts to produce a "Garment Measurement Chart" that is based on the subject's actual body measurements increased by the amount of ease required for the chosen garment, in the desired fit style, made with the selected fabric.

8. As shown in Step S112 in FIG. 2, the resultant "Garment Measurement Chart" is suitable to manufacture custom apparel.

Example

For the purposes of this example, we will postulate a female customer whose measurements (those that need to be adjusted for design, wear, and fabric ease) are:

Front Bust: 20"
Back Bust: 16"
Front Waist: 17"
Back Waist: 13"
Abdomen: 36"
Hip: 38"
Shoulder Length: 4.5"
Armscye: 15"
Upper Arm: 11"
Wrist: 6"

Step S102 of FIG. 2: This customer wishes to purchase a close fit blouse made with a cotton blend interlock knit fabric.

Step S104 in FIG. 2: We first look in the Design and Wear Ease Table of FIG. 4 and find that the relevant ease amounts are:

Front Bust: 2.5%
Back Bust: 2.5%
Front Waist: 5%
Back Waist: 5%
Abdomen: 3.5%
Hip: 5%
Women's Shoulder Extension: 5%
Armscye: 20%
Upper Arm: 25%
Wrist: 10%

Step S106 in FIG. 2: Next, we look up the fabric stretch adjustment amount from FIG. 6. A blouse made with a cotton blend interlock knit fabric should have ease adjustments of −1.8%, so each of the ease amounts obtained in Step 1 is reduced by this adjustment. The resulting ease for these measurements becomes:

Front Bust: 0.7%
Back Bust: 0.7%
Front Waist: 3.2%
Back Waist: 3.2%
Abdomen: 1.7%
Hip: 3.2%
Women's Shoulder Extension: 3.2%
Armscye: 18.2%
Upper Arm: 23.2%
Wrist: 8.2%

Steps S108-S110 in FIG. 2: With these ease amounts, we now increase each of the relevant body measurements by the percentage specified. For "Front Bust", we multiply the original 20" amount by 1.007 (0.7% greater) to get a new "Front Bust" measurement of 20.14". That particular adjustment was pretty trivial as it involved a close fit knit. Other garments and fabric combinations produce more significant ease amounts. The final values for each of these measurements becomes:

Front Bust: 20.14"
Back Bust: 16.112"
Front Waist: 17.544"

Back Waist: 13.416"
Abdomen: 36.612"
Hip: 39.216"
Shoulder Length: 4.644"
Armscye: 17.73"
Upper Arm: 13.552"
Wrist: 6.492"

Step 112 in FIG. 2: If the cotton interlock knit blouse is manufactured using these measurements, it should be as close fitting as possible while still comfortably providing room for unrestricted movement.

The embodiments of the invention in which an exclusive property or privilege is claimed are defined as follows:

1. A method for determining the amounts of ease to add to any garment being manufactured or hand made based on percentages of actual body measurements, rather than using any fixed amounts, comprising:

varying said percentage based on the garment style (outerwear, day-wear, active-wear, underwear, etc.), fit preference (stretch-to-fit, close fit, loose fit, relaxed fit, etc.) and fabric type (high-stretch, low-stretch, or no-stretch fabrics) used to make the garment.

2. The method of claim 1, including the step of determining garment dimensions in the chest or bust using a percentage of the actual chest or bust measurement(s) rather than any fixed amount, said percentage being a function of garment style, fit preference, and fabric type used to make the garment.

3. The method of claim 1, including the step of determining garment dimensions in the waist using a percentage of the actual waist measurement(s) rather than any fixed amount, said percentage being a function of garment style, fit preference, and fabric type used to make the garment.

4. The method of claim 1, including the step of determining garment dimensions in the hip using a percentage of the hip measurement(s) rather than any fixed amount, said percentage being a function of garment style, fit preference, and fabric type.

5. The method of claim 1, including the step of determining garment dimensions in the leg using a percentage of the leg measurement(s) rather than any fixed amount, said percentage being a function of garment style, fit preference, and fabric type used to make the garment.

6. The method of claim 1, including the step of determining garment dimensions in the arm using a percentage of the actual arm measurement(s) rather than any fixed amount, said percentage being a function of garment style, fit preference, and fabric type used to make the garment.

7. The method of claim 1, including the step of determining garment dimensions in the chest or bust using a percentage of the actual chest or bust measurement(s) rather than any fixed amount, said percentage varying based on the preferred garment style type such as outerwear, day-wear, active-wear, underwear, etc.

8. The method of claim 1, including the step of determining garment dimensions in the waist using a percentage of the actual waist measurement(s) rather than any fixed amount, said percentage varying based on the preferred garment style type such as outerwear, day-wear, active-wear, underwear, etc.

9. The method of claim 1, including the step of determining garment dimensions in the hip using a percentage of the hip measurement(s) rather than any fixed amount, said percentage varying based on the preferred garment style type such as outerwear, day-wear, active-wear, underwear, etc.

10. The method of claim 1, including the step of determining garment dimensions in the leg using a percentage of the actual leg measurement(s) rather than any fixed amount, said percentage varying based on the preferred garment style type such as outerwear, day-wear, active-wear, underwear, etc.

11. The method of claim 1, including the step of determining garment dimensions in the arm using a percentage of the actual arm measurement(s) rather than any fixed amount, said percentage varying based on the preferred garment style type such as outerwear, day-wear, active-wear, underwear, etc.

12. The method of claim 1, including the step of determining garment dimensions in the chest or bust using a percentage of the actual chest or bust measurement(s) rather than any fixed amount, said percentage varying based on the preferred garment fit preference such as stretch-to-fit, close fit, loose fit, relaxed fit, etc.

13. The method of claim 1, including the step of determining garment dimensions in the waist using a percentage of the actual waist measurement(s) rather than any fixed amount, said percentage varying based on the preferred garment fit preference such as stretch-to-fit, close fit, loose fit, relaxed fit, etc.

14. The method of claim 1, including the step of determining garment dimensions in the hip using a percentage of the actual hip measurement(s) rather than any fixed amount, said percentage varying based on the preferred garment fit preference such as stretch-to-fit, close fit, loose fit, relaxed fit, etc.

15. The method of claim 1, including the step of determining garment dimensions in the leg using a percentage of the actual leg measurement(s) rather than any fixed amount, said percentage varying based on the preferred garment fit preference such as stretch-to-fit, close fit, loose fit, relaxed fit, etc.

16. The method of claim 1, including the step of determining garment dimensions in the arm using a percentage of the actual arm measurement(s) rather than any fixed amount, said percentage varying based on the preferred garment fit preference such as stretch-to-fit, close fit, loose fit, relaxed fit, etc.

17. The method of claim 1, including the step of determining garment dimensions in the chest or bust using a percentage of the actual chest or bust measurement(s) rather than any fixed amount, said percentage varying based on the preferred garment's intended fabric stretch amounts, with different percentages used for high-stretch, low-stretch or no-stretch fabrics.

18. The method of claim 1, including the step of determining garment dimensions in the waist using a percentage of the actual waist measurement(s) rather than any fixed amount, said percentage varying based on the preferred garment's intended fabric stretch amounts, with different percentages used for high-stretch, low-stretch or no-stretch fabrics.

19. The method of claim 1, including the step of determining garment dimensions in the hip using a percentage of the actual hip measurement(s) rather than any fixed amount, said percentage varying based on the preferred garment's intended fabric stretch amounts, with different percentages used for high-stretch, low-stretch or no-stretch fabrics.

20. The method of claim 1, including the step of determining garment dimensions in the leg using a percentage of the actual leg measurement(s) rather than any fixed amount, said percentage varying based on the preferred garment's intended fabric stretch amounts, with different percentages used for high-stretch, low-stretch or no-stretch fabrics.

* * * * *